United States Patent [19]

Albright et al.

[11] 4,103,122

[45] Jul. 25, 1978

[54] HIGH VOLTAGE GROUNDING SWITCH REQUIRING LOW OPERATING EFFORT

[75] Inventors: Roy H. Albright, Greensburg; Walter B. Kelly, Laughlintown, both of Pa.

[73] Assignee: Gould Inc., Rolling Meadows, Ill.

[21] Appl. No.: 699,578

[22] Filed: Jun. 24, 1976

[51] Int. Cl.[2] ..... H01H 31/00

[52] U.S. Cl. ..... 200/48 P; 200/48 A; 200/51.13

[58] Field of Search ..... 200/48 A, 48 R, 48 P, 200/51.13

[56] References Cited

U.S. PATENT DOCUMENTS

| | | | |
|---|---|---|---|
| 1,919,065 | 7/1933 | Jacobs | 200/48 P |
| 2,227,925 | 1/1941 | Cornell et al. | 200/48 P |
| 2,806,097 | 9/1957 | Hoye | 200/48 P |
| 3,566,061 | 2/1971 | Bernatt | 200/48 R |

*Primary Examiner*—Brooks H. Hunt

*Attorney, Agent, or Firm*—Ostrolenk, Faber, Gerb & Soffen

[57] ABSTRACT

A high voltage grounding switch adapted to ground high voltage power lines or other electrical equipment is provided with a two-part blade having toggle type action, with the toggle joint placed near the hinge pivot. The blade is then rotated from a fully opened position toward a closed position in which the blade end engages an overhead jaw type contact. The engagement of the blade end with a stop which is adjacent the jaw contact straightens the toggle and forces sliding engagement between the blade end and the jaw contact in an axial direction relative to the blade axis. A counterbalancing spring is connected from the switch support to the blade in order to at least partly balance the blade mass and to maintain the blade in a toggle-collapsed condition. The telescoping action of the blade in its stationary jaw contact provides a mechanical stop against blowout forces produced by fault currents.

10 Claims, 14 Drawing Figures

HIGH VOLTAGE GROUNDING SWITCH REQUIRING LOW OPERATING EFFORT

BACKGROUND OF THE INVENTION

This invention relates to electrical switches, and more specifically relates to a grounding switch for connecting electrical equipment or overhead power lines in a high voltage power transmission line to ground. Grounding switches are well known to the art, and typically are shown in U.S. Pat. Nos. 2,420,485 and 2,699,482 which are each owned by the assignee of the present invention.

Prior art grounding switches are not well adapted for handling high momentary currents or, in some cases, for handling normal momentary currents in extremely high voltage transmission systems, such as those rated at 345 kV to 765 kV. Therefore, additional mechanisms or special construction must be provided for grounding switches which increase their cost and increase the operating forces necessary to operate the switches if they are to be capable of handling high momentary currents.

The present system provides a novel toggle arrangement and counterbalancing arrangement for the movable blade of a grounding switch which permits the blade to telescope into its cooperating stationary jaw contact when the contacts move into engagement, thereby to provide improved resistance to the magnetic blowoff forces produced by high momentary currents. The counterbalance arrangement further reduces the amount of operating effort necessary to move the switch from its open and toward its closed position. Operating effort is further reduced by a novel toggle type construction for the blade, whereby the operating mechanism has an increased mechanical advantage over the last few degrees of movement of the blade to its engaged position.

BRIEF DESCRIPTION OF THE INVENTION

In accordance with the invention, the movable blade of the ground switch is made of two sections which are part of a toggle mechanism where the toggle joint is placed relatively close to the blade hinge pivot rather than near the blade contact end as in some prior art switches.

In a preferred embodiment of the invention, the blade is in a horizontal position when opened, and is moved to a vertical position to reach upwardly to a stationary jaw contact when the switch is moved to its closed position. In the final movement of the switch blade to the closed position, the toggle is straightened and the blade telescopes into its cooperating overhead jaw contact. Clearly, the blade orientation need not be an orientation wherein it moves from a horizontal open position to a vertical closed position, but any orientation could be used.

A counterbalancing spring assembly is then connected to the blade at a point above the pivot so that the mass of the rotating blade is well counterbalanced, thereby to reduce the operating effort needed to move the blade toward the closed position to operate the switch. The novel switch of the invention can now be a relatively low-cost switch which is capable of handling high momentary currents since its current carrying capacity is high by virtue of a jaw contact which surrounds the cylindrical blade end casting. Moreover, the arrangement of the switch of the invention readily withstands stresses produced by fault currents which normally tend to force prior art blade ends out of the jaw contact. With the switch of the invention, the use of a telescoping type blade end, which telescopes into a surrounding jaw contact, cannot be moved by blowoff forces which are generally perpendicular to the blade. That is, blowoff forces would tend to open the switch of the present invention only if the blowoff forces were axial forces tending to telescope the moving blade out of its jaw contact. Clearly, however, the blowoff forces in such switches are perpendicular to the blade and are thereby confined by the jaw contact.

The operating effort needed to operate the switch is kept low because of the mechanical advantage achieved by the relatively small displacement angle between the two blade sections as well as because of the counterbalancing of the blade weight.

In the preferred embodiment of the invention, the blade end of the moving contact engages the jaw stop when the bottom blade section is about 20° to 25° from the vertical. Consequently, a fairly large angle of travel still remains for the bottom blade section, which travel is used to move the blade end vertically in a telescoping direction for only 2½ to 3 inches before a full telescoping contact is achieved.

A further advantage of the invention is that the blade end casting which makes electrical engagement with the overhead jaw contact is a separable member clamped to the blade end. Thus, the blade end casting position can be adjusted in order to provide the desired clearance with respect to the jaw finger contact as the blade end moves underneath the jaw while closing. This arrangement then substantially simplifies the manufacture of the switch since it makes the switch operation less dependent on the manufacturing tolerances.

DETAILED DESCRIPTION OF THE DRAWINGS

Figure 2:
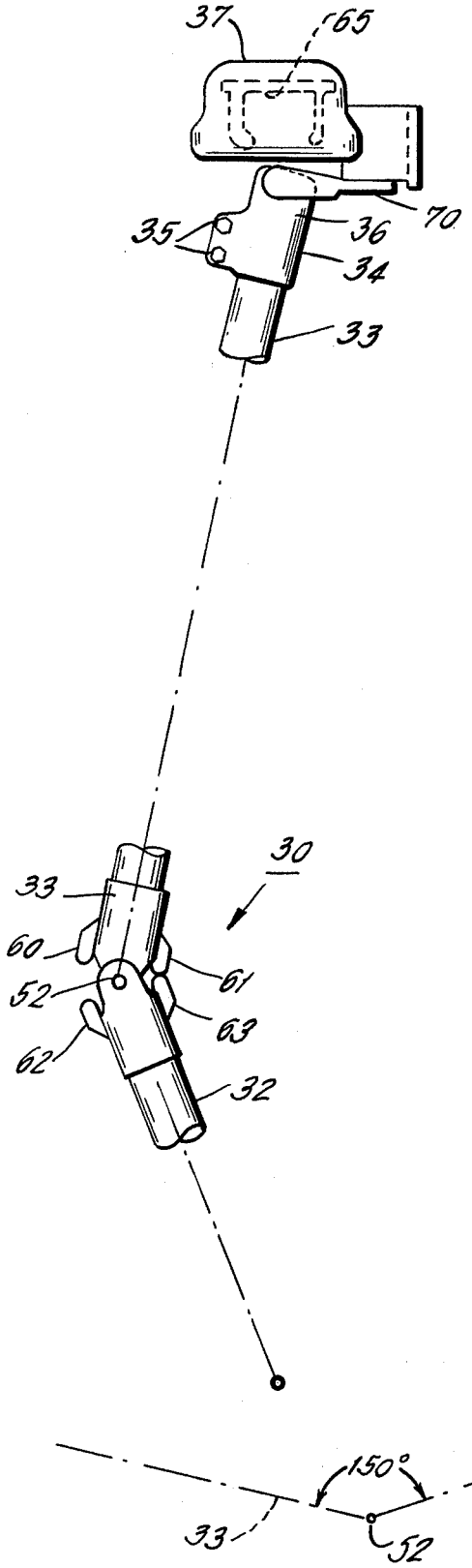
FIG. 2 schematically illustrates the position of the two blade components just prior to the telescoping engagement between the blade end and the overhead jaw contact and as the blade end meets the stop on the overhead jaw.

Referring first to FIGS. 1 to 5, the novel switch shown therein comprises a metal support frame 20 which rotatably receives a main mounting rod 21. The frame member 20 is provided with suitable mounting pads, such as mounting pads 22, 23 and 24 (FIG. 3) to enable the mounting of the frame on a grounded switch tower or switch support for a conventional type of disconnect switch or the like. Rod 21 then has an operating crank 25 bolted thereto, where the crank 25 can rotate through an angle typically of about 108° and between the lines 26 and 27 in FIGS. 1 and 5. Other angles can be selected by the designer. Suitable stop pads, such as pads 28 and 29, are fixed to the frame 20 to provide stop surfaces for limiting the rotation of crank 25 to the arc between lines 26 and 27.

Figure 6:
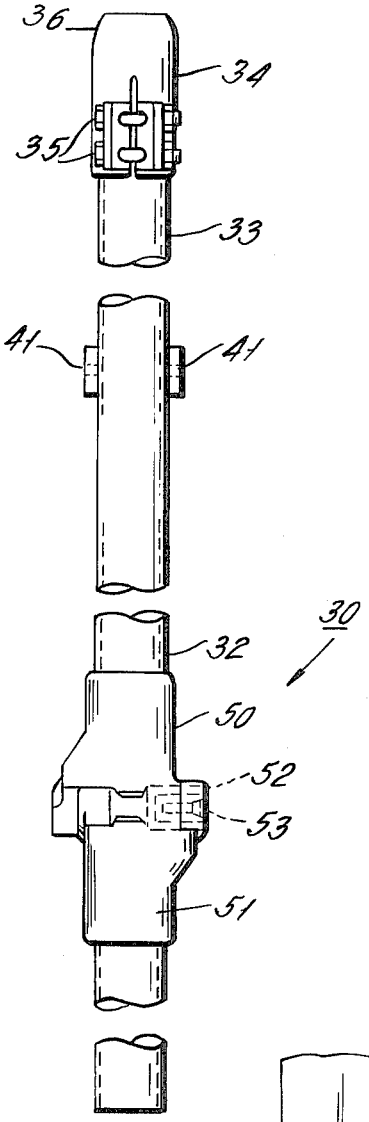
FIG. 6 is a plan view of the blade assembly of the switch of the present invention.
Figure 7:
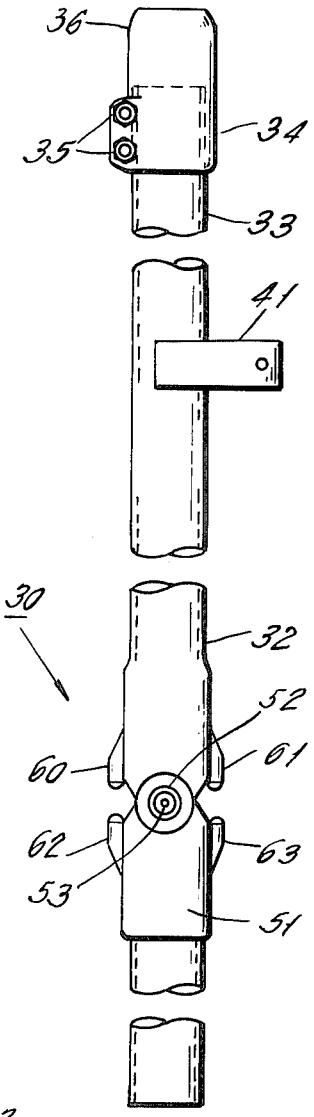
FIG. 7 is a side view of FIG. 6.

A contact blade 30 is also clamped to rotating rod 21 as by the conventional clamping device 31 where the blade 30, which is shown in detail in FIGS. 6 and 7, is formed of two pivotally connected parts 32 and 33, as will be later described. Blade portion 33 is terminated with a contact casting 34 which is suitably clamped to the blade portion 33 as by clamping bolts 35, and the contact casting 34 terminates in a circular blade or bayonet type contact surface 36.

Figure 10:
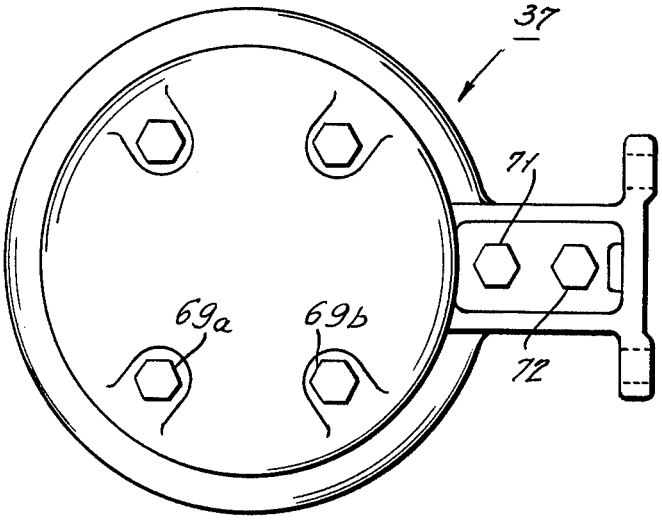
FIG. 10 is a top view of the jaw contact shield of FIG. 9.

The telescoping bayonet type contact 36 is then movable into and out of engagement with a jaw contact assembly 37, which will later be described in detail in connection with FIGS. 9 and 10. The stationary jaw contact 37 is then suitably fixed to some stationary support (not shown) and can be electrically connected to any electrical equipment or power line which is to be grounded by the grounding switch of this invention when the grounding switch is closed.

Figure 1:
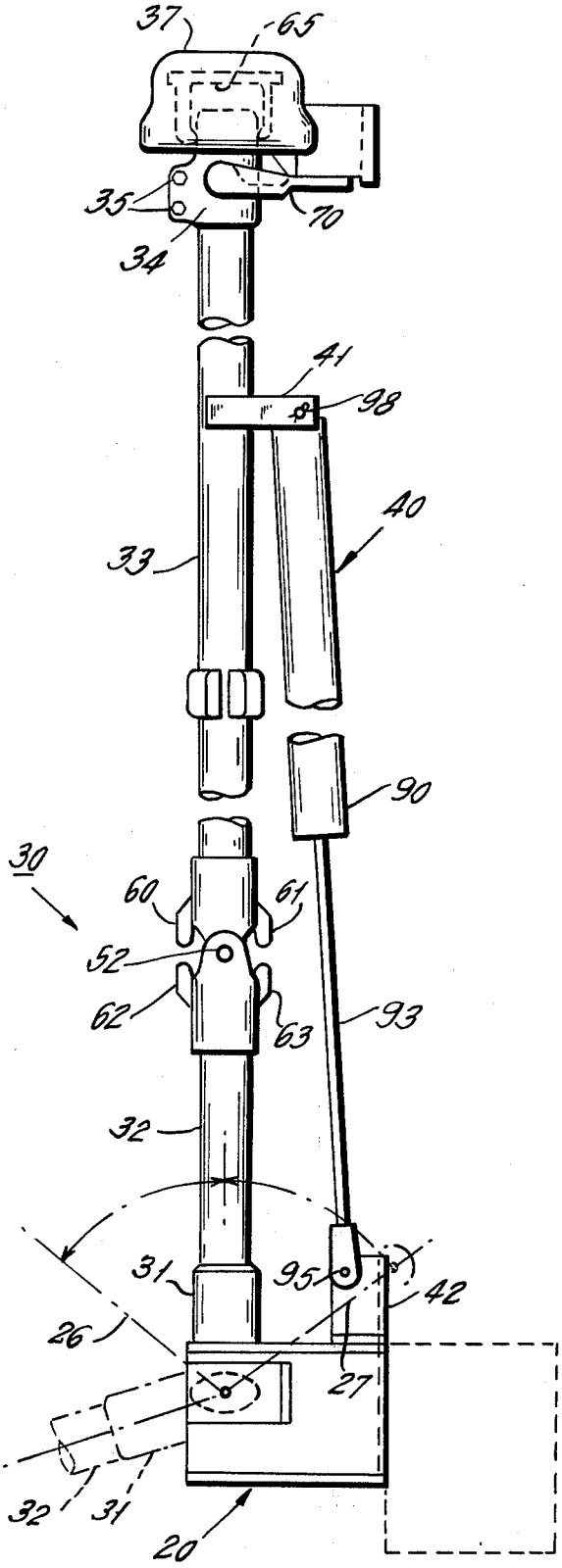
FIG. 1 is an elevational view of the grounding switch of the present invention with the switch blade in its engaged position and with dotted lines illustrating the switch blade open position.

FIG. 1 further illustrates the provision of a counterbalance mechanism 40 which has one end pivotally connected to bracket 41 on blade portion 33 and has its other end pivotally connected to mounting bracket 42 (FIGS. 11 and 12) which is fixed to frame 20.

Figure 8:
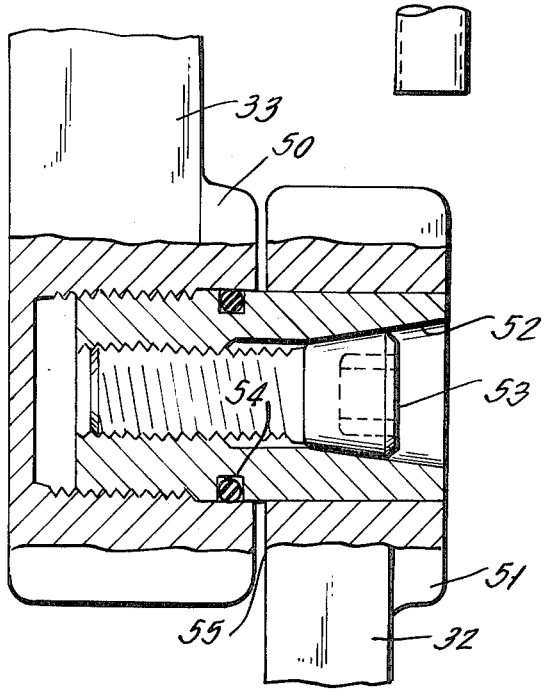
FIG. 8 is a partial cross-sectional view illustrating the pivotal connection between the two blade sections of FIGS. 6 and 7.

The movable blade 30 is shown in more detail in FIGS. 6, 7 and 8 where it is seen that the blade sections have pivot castings 50 and 51 fixed to their adjacent ends. Pivot castings 50 and 51 are pivotally connected to one another by a conductive hinge pin 52, best shown in FIG. 8, which is fixed in position by a locking bolt 53. A suitable weather seal 54 (FIG. 8) is fitted around the exterior of hinge pin 52, as shown in FIG. 8. The castings 50 and 52 are spaced from one another by a suitable clearance spacing 55 which may be about 1/16 of an inch when the movable blade is in its extended and closed position. The construction shown for the hinged mounting of the blade sections 32 and 33 is only one of any desired arrangement which will enable a hinge connection which can carry the current of the grounding switch with relatively low resistance.

The contact castings 52 and 53 also contain rotation stops 60–61 and 62–63, respectively, which limit the maximum angle which can occur between the upper and lower blades 32 and 33. Thus, the maximum angle between these blade sections is obtained when interference members 60 and 62 engage or when interference members 61 and 63 engage. These angles are chosen to be, for example 30° so that, when the blades 32 and 33 are in the fully collapsed position of FIG. 2, they will have an included angle of 150° between their axes. Clearly, the designer can choose any desired angle. Note further that the designer can choose this angle to coordinate it with the length needed for blade 33 in a given application, whereas the length of blade 32 can be standardized in one or two sizes. Note that the same joint assembly can be used over a wide range of blade lengths.

Figure 9:
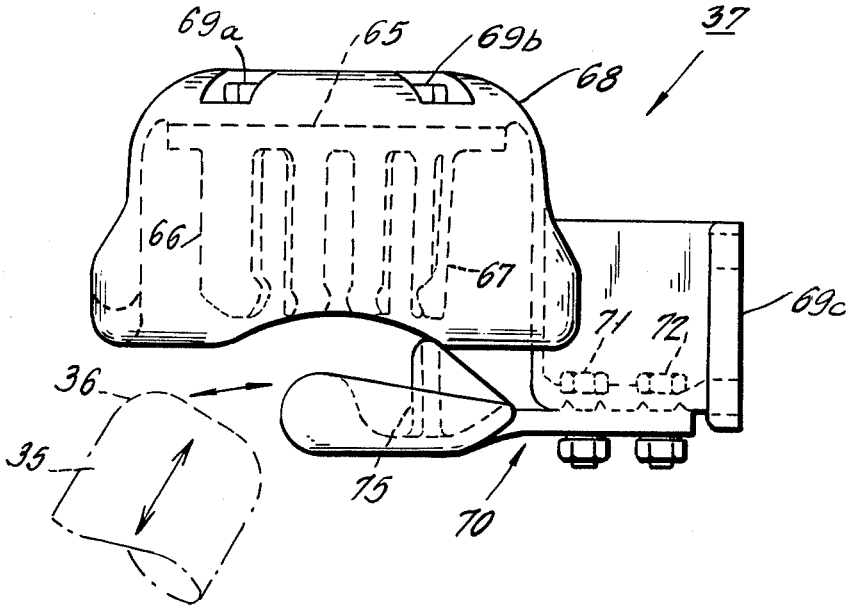
FIG. 9 is a side view of the overhead contact assembly used for the switch of the invention.

The jaw contact 37 which cooperates with the blade contact and specifically the blade contact casting 36 of FIGS. 6 and 7 is shown in detail in FIG. 9 and consists of a contact assembly 65 which contains a cluster of flexible fixed jaw contact fingers, such as jaw contact fingers 66 and 67 which receive contact surface 36 of blade contact casting 34 in high pressure contact as the casting 34 slides into fingers 66 and 67. The contact assembly 65 is suitably bolted to the jaw shield casting 68 by suitable bolts, such as bolts **69*a* and 69*b*, and casting 68 is terminated by a mounting flange 69*c* which enables the connection of the jaw to the contact of a suitable disconnect switch or other conductor which is associated with the grounding switch of the invention. Contact finger 66 is preferably heavier than contact finger 67 or the other contact fingers of the cluster to enable it to resist blowoff forces during short circuit conditions. Blade stop member 70 is then bolted to the casting 68 by the bolts 71 and 72 and has a semicircular opening 75 which receives and stops the arcuate motion of blade end casting 34 to force the blade end casting to move with axial movement and into telescoping engagement with the jaw contact 65**.

Figure 4:
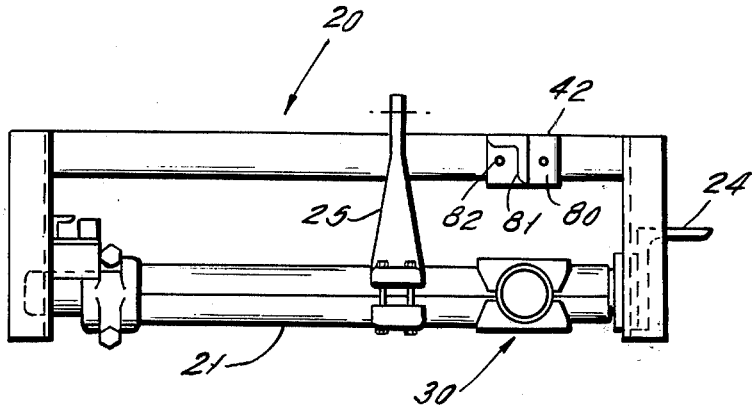
FIG. 4 is a top view of the switch of FIGS. 2 and 3.
Figure 5:
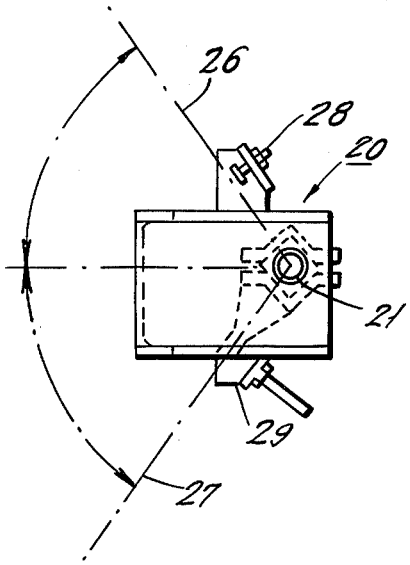
FIG. 5 is a side view of the switch of FIG. 3 particularly to indicate the operating crank operation.
Figure 3:
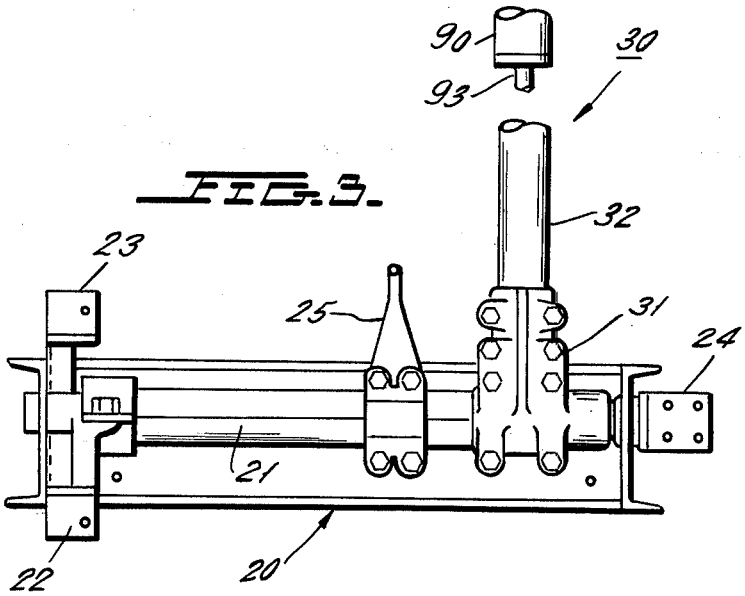
FIG. 3 is a side plan view of FIGS. 1 and 6.
Figure 11:
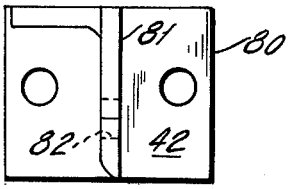
FIG. 11 is an end view of the counterbalance mounting bracket.
Figure 12:
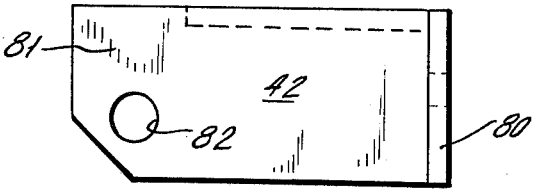
FIG. 12 is a side view of FIG. 11.

FIGS. 11 and 12 illustrate the construction of the counterbalance mounting bracket 42 which is shown in FIGS. 1 and 4 wherein the mounting bracket has a bottom end 80, which is fixed to frame 20, and an upwardly extending bracket section 41 which has an opening 82 therein, which pivotally receives one end of the counterbalance mechanism 40.

Figure 13:
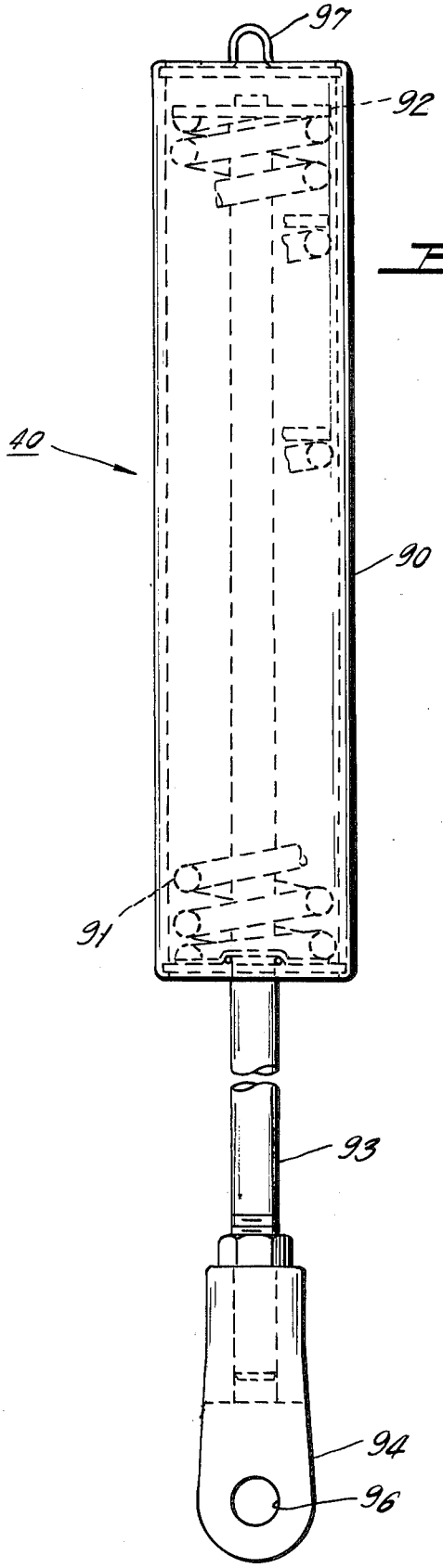
FIG. 13 is a plan view of the counterbalance assembly.
Figure 14:
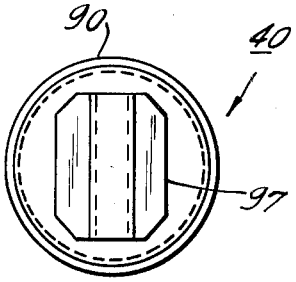
FIG. 14 is an end view of FIG. 13.

Counterbalance structure 40 is shown in FIGS. 13 and 14 and consists of a housing 90 which contains a compression spring 91 having one end pressing on the end of housing 90 and its other end connected to a plate 92. The plate 92 is then connected to a plunger 93 which is, in turn, connected to a clevis 94. Clevis 94 is pivotally connected to the counterbalance mounting bracket by means of a pin 95 (FIG. 1) which extends through the openings 96 in clevis 94 and the opening 82 in the mounting bracket 42. A hinge cap 97 is then connected to the end of housing 90 and hinge cap 97 is pivotally connected to bracket 41 on contact member 33 as shown in FIG. 1, as by a stainless steel pivotable mounting pin 98.

The force exerted by the counterbalance assembly 40 is suitably adjusted by lengthening or shortening plunger 93 as by threading the clevis 94 deeper or less deep onto plunger 93.

The same spring 91 can be used for the counterbalancing of a wide range of blade lengths by suitably dimensioning bracket 42 to alter the spring force. Moreover, a weight, not shown, can be suitably clamped to blade 33 at a suitable point along the blade.

The operation of the switch as shown in FIGS. 1 and 2 can now be described.

When the switch is in the open position, the switch blade members 32 and 33 are in the dotted-line position shown in FIG. 1, and the operating crank 25 is rotated to the position 26 in FIG. 1. When it is now desired to close the grounding switch, the operating crank 25 is rotated through an angle of about 108° and in a clockwise direction from position 26 to position 27 in FIG. 1.

During the rotation of the contact, the blade portions 32 and 33 will remain collapsed in the position shown in dotted lines in FIG. 1, and in solid line in FIG. 2, with an included angle of about 150°, under the influence of spring 91 of the counterbalance mechanism 40. That is to say, the force exerted by spring 91 of counterbalance mechanism 40 will tend to rotate the blade assembly in a clockwise direction and will tend to maintain the switch members 32 and 33 in the toggle-broken position shown in FIG. 2. This spring force will also tend to offset the force required to raise the mass of the movable contact blade from the horizontal to the vertical position. This spring force decreases until the position of FIG. 2 is reached and the spring force is at a minimum.

Once the blade portions 32 and 33 assume the angles shown in FIG. 2 and after a rotation of about 78°, the surface of the blade casting 34 engages the inner surface of switch blade stop opening 75 of stop member 70 secured to the stationary jaw contact 37, so that continued angular movement of the top end of switch blade member 33 is impossible. Consequently, the continued motion of the operating crank 25 causes the toggle formed between switch blade members 32 and 33 to straighten toward the position of FIG. 1, thereby causing axial movement of about 2 to 3 inches of the switch blade casting 34 into sliding engagement with the contact fingers 66 and 67 of the jaw contact member 65. The straightening of the toggle also causes an increase in the force on the toggle joint due to spring 91 to apply pressure on the threaded contact joint of FIG. 8 to improve its current carrying ability.

The movement of the operating crank 25 terminates when the operating crank 25 reaches the position 27 in FIG. 1, thereby locking the blade members 32 and 33 into the straight-line position shown in FIG. 1. Note that, with the blade members 32 and 33 in this straight-line position, the grounding switch can easily resist magnetic blowoff forces created by high momentary currents since the blade casting 34 is securely locked within the surrounding jaw contact fingers 66 and 67 of the jaw contact member 65.

In order to open the switch, the operating crank 25 is moved from position 27 toward position 26 in FIG. 1. The initial movement of the blade will be axially downward and will be assisted by the spring 91.

Note that the upper end of casting 34 cannot initially move angularly to the left in FIG. 1, but must first move axially down before the blade assembly can rotate in a counterclockwise direction. Spring 91 causes blade sections 32 and 33 to pivot relative to one another until stops 61 and 63 are engaged. While the toggle is collapsing and once the upper end of contact casting 34 clears the jaw contact 37, the entire blade begins to rotate counterclockwise to the dotted-line position of FIG. 1, and the collapsed blade remains in this position when the crank 25 reaches its position 26. When the switch reaches the fully open position of FIG. 1, the lower blade has a downward slope of about 18° to the horizontal. This has been found sufficient to provide clearance in most instances.

Although there has been described a preferred embodiment of this novel invention, many variations and modifications will now be apparent to those skilled in the art. Therefore, this invention is to be limited, not by the specific disclosure herein, but only by the appended claims.

The embodiments of the invention in which an exclusive privilege or property is claimed are defined as follows:

1. A high voltage grounding switch comprising, in combination: a support base; a rotatable switch blade consisting of first and second elongated blade sections pivotally connected to one another at adjacent ones of their ends; a fixed jaw contact spaced from said support base by a fixed distance; the opposite end of said first blade section being rotatably mounted on said support base; a telescoping contact means connected to the opposite end of said second blade section and adapted to slidingly axially engage and disengage said jaw contact when said rotatable switch blade is operated between an engaged and disengaged position; blade rotating means connected to said first blade section for rotating said blade between an engaged and disengaged position relative to said fixed jaw contact; stop means connected to said first and second blade sections to define a minimum included angle between their axes of less than about 170° and more than about 120°; second stop means on said jaw contact for receiving and stopping the angular movement of said blade as said blade approaches said fixed jaw contact; and biasing means connected between said first and second blade sections for holding said blade sections in a collapsed-toggle position relative to one another.

2. The switch of claim 1 wherein said first blade section is shorter than said second blade section.

3. The switch of claim 1 wherein said jaw contact is disposed vertically above said support base.

4. The switch of claim 1 wherein said support base has a rotationally mounted rod thereon; said first blade section and said blade rotating means being connected to said rod.

5. The switch of claim 1 wherein said biasing means includes a counterbalance mechanism connected between said second blade section and said support base.

6. The switch of claim 1 wherein said contact means on said second blade section is a conductive casting adjustably secured to said other end of said second blade section.

7. The switch of claim 1 wherein said contact means on said second blade section has an axial movement of from about 2 to 3 inches into said jaw contact after said blade engages said second stop means on said jaw contact, and when said first and second blade sections straighten out to an in-line condition, from their said collapsed-toggle position.

8. The switch of claim 2 wherein said contact means on said second blade section has an axial movement of from about 2 to 3 inches into said jaw contact after said blade engages said second stop means on said jaw contact, and when said first and second blade sections straighten out to an in-line condition, from their said collapsed-toggle position.

9. The switch of claim 8 wherein said included angle is about 150°.

10. The switch of claim 9 wherein said biasing means includes a counterbalance mechanism connected between said second blade section and said support base.

* * * * *